US009687896B2

(12) United States Patent
Grisham et al.

(10) Patent No.: US 9,687,896 B2
(45) Date of Patent: Jun. 27, 2017

(54) SHEET METAL BRAKE PRESS

(71) Applicant: GrishamWorks, LLC, Oak Hills, CA (US)

(72) Inventors: Robert Grisham, Oak Hills, CA (US); Keith Smith, Oak Hills, CA (US)

(73) Assignee: GrishamWorks, LLC, Oak Hills, CA (US)

( * ) Notice: Subject to any disclaimer, the term of this patent is extended or adjusted under 35 U.S.C. 154(b) by 255 days.

(21) Appl. No.: 14/685,535

(22) Filed: Apr. 13, 2015

(65) Prior Publication Data

US 2016/0296988 A1 Oct. 13, 2016

(51) Int. Cl.

| | |
|---|---|
| ***B21D 9/05*** | (2006.01) |
| ***B21D 5/02*** | (2006.01) |
| ***B21D 7/06*** | (2006.01) |
| ***B21D 15/04*** | (2006.01) |

(52) U.S. Cl.

CPC ..... *B21D 5/02* (2013.01); *B21D 7/06* (2013.01); *B21D 15/04* (2013.01)

(58) Field of Classification Search

CPC .. B21D 5/02; B21D 7/06; B21D 15/04; F16K 7/06

USPC ..... 72/389.1, 389.6, 455, 384

See application file for complete search history.

(56) References Cited

U.S. PATENT DOCUMENTS

| | | | | |
|---|---|---|---|---|
| 2,502,072 A * | 3/1950 | Bender | B30B 15/0029 | 100/226 |
| 4,242,903 A * | 1/1981 | Ledford | F16K 7/06 | 100/257 |
| 4,574,611 A * | 3/1986 | Hegemann | B21D 5/02 | 72/389.3 |
| 4,782,686 A * | 11/1988 | Carson, Jr. | B21D 7/06 | 72/373 |
| 5,661,994 A * | 9/1997 | Sundquist | B21D 7/06 | 72/389.1 |
| 5,836,196 A * | 11/1998 | Smith | B21D 5/02 | 72/384 |
| 6,820,455 B1 * | 11/2004 | Bainter | B30B 15/04 | 100/214 |
| 6,959,581 B2 * | 11/2005 | Kanno | B21D 5/02 | 72/389.4 |
| 7,013,694 B1 * | 3/2006 | Sims | B21D 5/02 | 72/326 |

* cited by examiner

*Primary Examiner* — David B Jones

(74) *Attorney, Agent, or Firm* — Knobbe Martens Olson & Bear, LLP

(57) ABSTRACT

One embodiment of a brake press for bending and forming sheet metal is disclosed. The brake press includes a movable frame including an upper cross member and a lower cross member and a stationary press positioned between the upper and lower cross members. A punch edge secured to the upper cross member moves towards and away from a die positioned on the stationary press to bend a sheet metal workpiece into a desired configuration, In some embodiments, a hydraulic control assembly provides precise and accurate control of the brake press.

19 Claims, 9 Drawing Sheets

SHEET METAL BRAKE PRESS

FIELD OF THE INVENTION

The invention relates generally to press brakes or brake presses for bending or forming sheet metal.

DESCRIPTION OF THE RELATED ART

A press brake or brake press is commonly used for bending sheet and plate material, most commonly sheet metal. Bends may be formed by clamping the workpiece between a matching punch and die. A series of predetermined bends may be applied to a single workpiece. However, forming a box or "closing the bend" is generally difficult or impossible as the workpiece cannot be easily removed from the press.

SUMMARY OF THE INVENTION

One aspect of at least one embodiment of the invention is the recognition that it would be desirable to have a brake press with a removable or pivotable top bar or die to allow boxed or closed bend workpieces to be easily removed from the press.

In some embodiments, including the illustrated embodiment a brake press includes a movable frame comprising a first side support and a second side support, an upper frame assembly and a lower frame assembly, the upper frame assembly comprising an upper cross member connected to first ends of the first and second side supports, and the lower frame assembly comprising a lower cross member connected to second ends of the first and second side supports, the second ends opposite the first ends of the first and second side supports, the frame defining a vertical plane, the frame comprising a punch edge movable with said upper cross member, the punch edge extending towards the lower cross member and the upper cross member pivotable with respect to at least one of the first and second side supports; a stationary press assembly comprising a first press support, a second press support, and a die supported directly or indirectly by the first and second press supports and facing the punch edge, the first and second press supports connected to each other to define an elongated opening between them, a first end of the press assembly connected to a first guide and a second end of the press assembly opposite the first end connected to a second guide, the first guide configured such that the first side support travels vertically with respect to the first guide as the frame travels in the vertical plane, the second guide configured such that the second side support travels vertically with respect to the second guide as the frame travels in the vertical plane; and a power assembly comprising at least two hydraulic rams, a hydraulic power unit, and an input control assembly connected to the at least two hydraulic rams and the hydraulic power unit, the at least two hydraulic rams supported by the lower cross member and connected to the press assembly such that activation of the power assembly by the input control assembly controls the motion of the frame assembly in the vertical plane such that the punch edge moves towards and away from the press assembly.

In some aspects, the frame first side support comprises a first pivot and a second pivot, a front surface, back surface, and left and right surfaces such that the front and back surfaces form a first channel on a first end of the first side support configured to receive a first end of the upper cross member and the second side support comprises a front surface, back surface, and left and right surfaces such that the front and back surfaces form a second channel on a first end of the second side support configured to receive a second end of the upper cross member and the first and second channels are configured such that either of the first end or the second end of the upper cross member can rotate in the vertical plane with respect to one of the first and second side supports.

In some aspects, the lower cross member comprises a first channel and a second channel, the first channel connected to the first and second side supports and the second channel connected to the first and second side supports to define an opening between the first and second channels. In some aspects, the lower cross member further comprises a bottom plate connected to an underside of the first and second channels. In some aspects, the input control assembly comprises a control component connected to the two hydraulic rams and the hydraulic reservoir via a four-way valve such that pressing the control component in a first direction controls the speed of frame moving the punch edge towards the die, pressing the control component in a second direction controls the speed of the frame moving the punch edge away from the die, and releasing the control component stops movement of the frame. In some aspects, the control component is foot-operated.

In some aspects, the brake press further includes a pivoting assembly comprising a lower pivot support secured to a first end of the press assembly, an upper pivot support connected to a first end of the upper frame assembly, and a linkage connecting the lower pivot support to the upper pivot support such that movement of the frame in a vertical direction within the vertical plane rotates a second end opposite the first end of the upper cross member of the upper frame assembly away from one of the first and second side supports. In some aspects, the first ends of the first and second side supports have U-shaped supports with two bolts on each side to connect the upper cross member to each of the first and second side supports, the U-shaped supports having a clearance between a lower interior surface of the U-shaped supports and the upper cross member to allow pivoting of the upper cross member.

In some aspects, the die is a 4-sided rotatable die. In some aspects, the punch edge is non-integral with the upper cross member. In some aspects, the punch edge is directly or indirectly secured to the upper cross member. In some aspects, the die is non-integral with the first and second press supports. In some aspects, the die is directly or indirectly secured to the first and second press supports.

In another embodiment, a brake press includes a movable frame comprising a first side support and a second side support, an upper frame assembly and a lower frame assembly, the upper frame assembly comprising an upper cross member connected to first ends of the first and second side supports, and the lower frame assembly comprising a lower cross member connected to second ends of the first and second side supports, the second ends opposite the first ends of the first and second side supports, the frame defining a vertical plane, the frame comprising a punch edge movable with said upper cross member, the punch edge extending towards the lower cross member and the upper cross member pivotable with respect to at least one of the first and second side supports; a stationary press assembly comprising a first press support, a second press support, and a die supported directly or indirectly by the first and second press supports and facing the punch edge, the first and second press supports connected to each other to define an elongated opening between them, a first end of the press assembly connected to a first guide and a second end of the press assembly opposite the first end connected to a second guide, the first guide configured such that the first side support travels vertically with respect to the first guide as the frame travels in the vertical plane, the second guide configured such that the second side support travels vertically with respect to the second guide as the frame travels in the vertical plane; and a power assembly comprising at least two hydraulic rams, a hydraulic power unit, and an input control assembly connected to the at least two hydraulic rams and the hydraulic power unit, the at least two hydraulic rams supported by the lower cross member and connected to the press assembly such that activation of the power assembly by the input control assembly controls the motion of the frame assembly in the vertical plane such that the punch edge moves towards and away from the press assembly; wherein the input control assembly comprises a control component connected to the two hydraulic rams and the hydraulic reservoir via a four-way valve such that pressing the control component in a first direction controls the speed of frame moving the punch edge towards the die, pressing the control component in a second direction controls the speed of the frame moving the punch edge away from the die, and releasing the control component stops movement of the frame.

In some aspects, the frame first side support comprises a first pivot and a second pivot, a front surface, back surface, and left and right surfaces such that the front and back surfaces form a first channel on a first end of the first side support configured to receive a first end of the upper cross member and the second side support comprises a front surface, back surface, and left and right surfaces such that the front and back surfaces form a second channel on a first end of the second side support configured to receive a second end of the upper cross member and the first and second channels are configured such that either of the first end or the second end of the upper cross member can rotate in the vertical plane with respect to one of the first and second side supports. In some aspects, the control component is foot-operated In some aspects, the brake press further includes a pivoting assembly comprising a lower pivot support secured to a first end of the press assembly, an upper pivot support connected to a first end of the upper frame assembly, and a linkage connecting the lower pivot support to the upper pivot support such that movement of the frame in a vertical direction within the vertical plane rotates a second end opposite the first end of the upper cross member of the upper frame assembly away from one of the first and second side supports. In some aspects, the first ends of the first and second side supports have U-shaped supports with two bolts on each side to connect the upper cross member to each of the first and second side supports, the U-shaped supports having a clearance between a lower interior surface of the U-shaped supports and the upper cross member to allow pivoting of the upper cross member.

In another embodiment, a method of using a brake press includes assembling a brake press comprising the steps of providing a movable frame comprising a first side support and a second side support, an upper frame assembly and a lower frame assembly, the upper frame assembly comprising a upper cross member connected to first ends of the first and second side supports, and the lower frame assembly comprising a lower cross member connected to second ends of the first and second side supports, the second ends opposite the first ends of the first and second side supports, the frame defining a vertical plane, the frame comprising a punch edge movable with said upper cross member, the punch edge extending towards the lower cross member and the upper cross member pivotable with respect to at least one of the first and second side support members; providing a stationary press assembly comprising a first press support, a second press support, and a die supported directly or indirectly by the first and second press supports and facing the punch edge, the first and second press supports connected to each other to define an elongated opening between them, a first end of the press assembly connected to a first guide and a second end of the press assembly opposite the first end connected to a second guide, the first guide configured such that the first side support travels vertically with respect to the first guide as the frame travels in the vertical plane, the second guide configured such that the second side support travels vertically with respect to the second guide as the frame travels in the vertical plane; and providing a power assembly comprising at least two hydraulic rams, a hydraulic power unit, and an input control assembly connected to the hydraulic rams and the hydraulic power unit, the at least two hydraulic rams supported by the lower cross member and connected to the press assembly such that activation of the power assembly by the input control assembly controls the motion of the frame assembly in the vertical plane such that the punch edge moves towards and away from the press assembly; inserting a piece to be pressed between the punch edge and the die; and operating the brake press, comprising the steps of manipulating the input control assembly to lower the frame assembly relative to the press assembly to press the piece between the die and the punch edge.

DETAILED DESCRIPTION OF THE PREFERRED EMBODIMENT

The following detailed description is directed to certain specific embodiments of the invention. However, the invention may be embodied in a multitude of different ways as defined and covered by the claims.

In the following description, numerous aspects of the sheet metal brake press provide advantages over prior sheet metal brake press designs. References to certain aspects as important or significant does not imply that each and every one of the referenced aspects are required in all embodiments of the invention to provide advantages over the prior art. Use of terms such as "left," "right," "front," "back," "up," "down," forward," and "downward" are merely descriptive to aid in understanding the orientation of the brake press.

In the illustrated embodiments, a sheet metal brake press has two vertically-mounted hydraulic rams that may be activated to move a frame, including a punch edge, vertically up and down towards and away from a die member. As the punch edge approaches the die member, a workpiece, such as a piece of sheet metal placed between the punch edge and the die member, is bent due to the force of the moving punch edge acting against the workpiece that is clamped between the punch edge and the die member.

Figure 1:
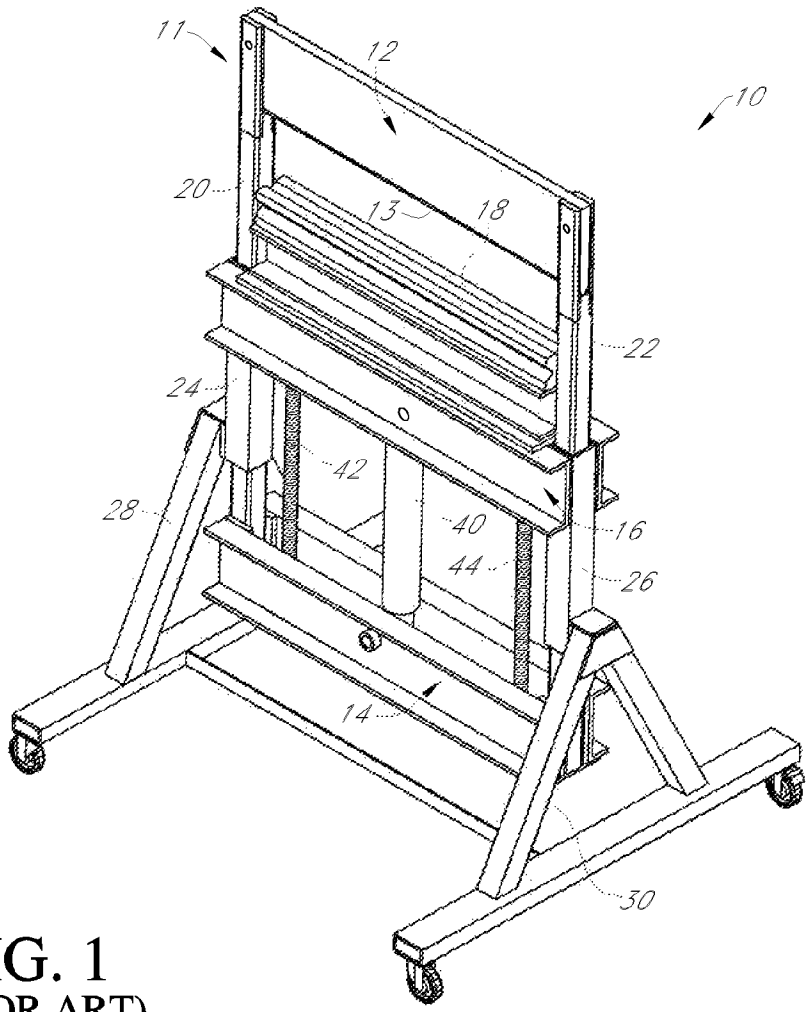
FIG. 1 (PRIOR ART)
FIG. 1 is a front perspective view of a sheet metal brake press, according to the prior art.

FIG. 1 shows a prior art sheet metal press previously developed by the inventors. The press 10 includes a movable frame 11 constructed from a top frame assembly 12, a bottom frame assembly 14, and two side frame members 20, 22. A stationary press assembly 16 includes left 24 and right 26 side guide members. The guide members 24, 26 are hollow members that have a larger cross section than the side frame members 20, 22. As the movable frame 11 moves up and down in a vertical plane, the side frame members 20, 22 travel within the guide members 24, 26. The left and right side guide members 24, 26 are connected to support frames 28 and 30. The top frame assembly 12 can include a punch edge 13 configured to mate with a coordinating die member 18 connected to or placed on the top of the press assembly 16. A single hydraulic ram 40 is connected to the bottom frame assembly 14 and the press assembly 16. A pair of springs 42, 44 is also connected to the bottom frame assembly 14 and the press assembly 16.

A workpiece, such as a piece of sheet metal, is placed on the die member 18. As the hydraulic ram 40 is activated, the bottom frame assembly 14 is pushed away from the press assembly 16. As the bottom frame assembly 14 travels downward such that the bottom frame assembly 14 approaches the ground, the side frame members 20, 22 travel within the side guide members 24, 26 and the top frame assembly 12 and the punch edge 13 descend toward the press assembly 16 and the die member 18. The hydraulic ram 40 acts on the movable frame 11, pushing the frame 11 downward until the punch edge 13 of the top frame assembly 12 applies pressure to the workpiece to bend the metal workpiece between the punch edge 13 and the die member 18. Once the hydraulic ram is deactivated, the springs 42, 44 act to immediately pull the movable frame 11 upwards, possibly resulting in mistaken bends. Additionally, the hydraulic ram 40 cannot be accurately and discretely controlled, leading to errors in operation and ruined workpieces. Furthermore, the heavy top frame assembly 12 is not easily removed from the movable frame 11. Thus, workpieces that are formed into a "box" shape (that is, a piece that is formed with three approximately 90 degree bends to form a box shape) may not be easily removed from the press.

One aspect of at least one improvement is the recognition that it would be desirable to have an improved sheet metal brake press that may be more accurately controlled and easily operated. Additionally, another aspect of at least one embodiment is the recognition that it would be desirable to have a press configured such that the top frame assembly may be easily removed or pivoted away from the frame of the press to allow the removal of a "box" formed shape.

Figure 2:
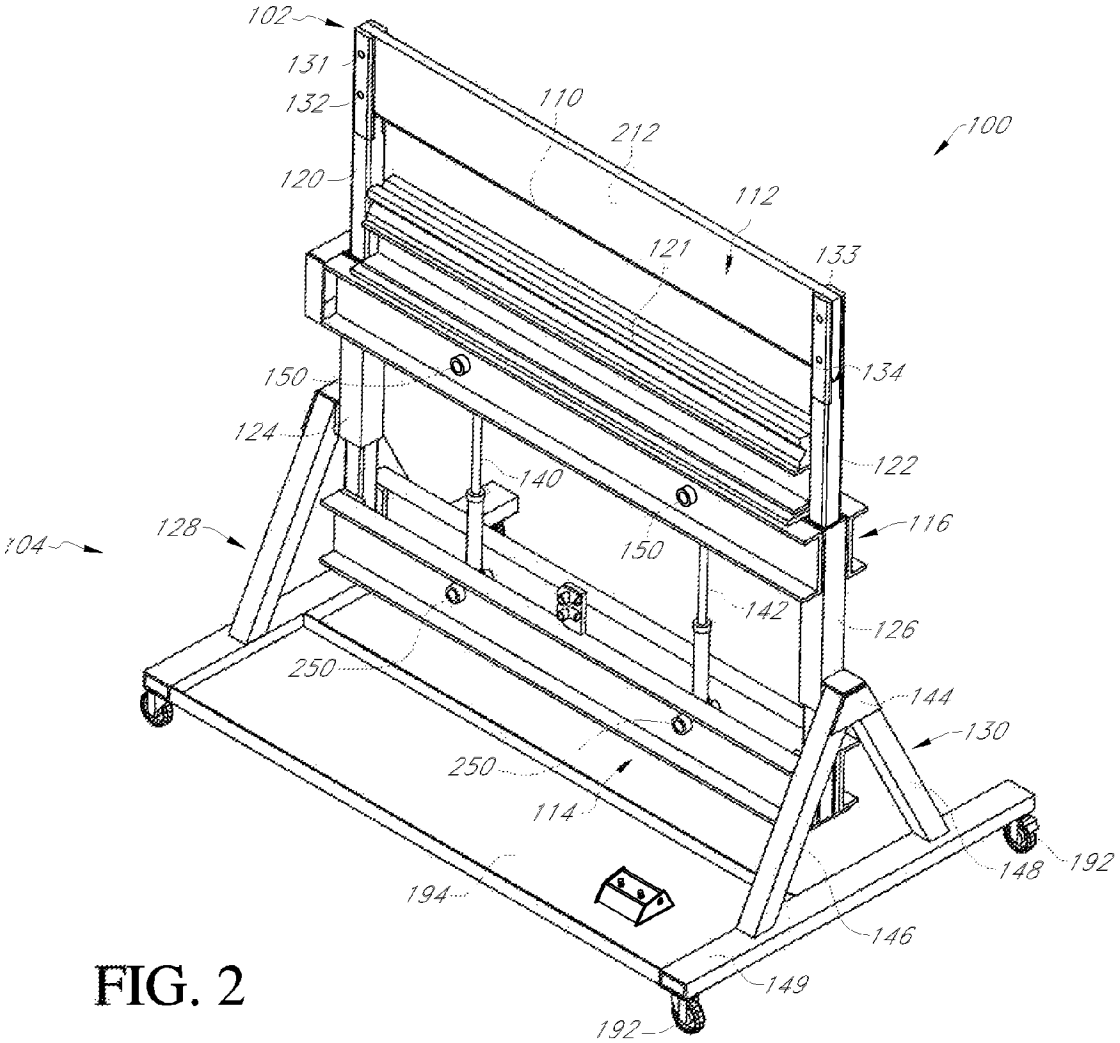
FIG. 2 is a front perspective view of a sheet metal brake press, according to one aspect of the disclosure.

FIG. 2 illustrates one embodiment of a sheet metal brake press. The press 100 includes a movable frame 102, a press assembly 116, and a support assembly 104. The movable frame 102 includes an upper frame assembly 112, a lower frame assembly 114, and two side frame supports 120, 122 to define a vertical plane. The stationary press assembly 116 includes left 124 and right 126 side guides. The guides 124, 126 are hollow members that have a larger cross section than the side frame members 120, 122. As the movable frame 112 moves up and down in the vertical plane, the side frame supports 120, 122 travel with respect to the guides 124, 126. In some embodiments, the side frame supports 120, 122 engage the guides 124, 126. The left and right side guides 124, 126 are connected to the support assembly 104. The support assembly 104 includes left and right support frames 128 and 130. Each of the support frames 128, 130 may be an A-frame shaped support. In one example, the right support frame 130 may include forward and rear supports 146, 148 each having an upper end and a lower end. The upper ends of the forward and rear supports 146, 148 are connected by a cap 144. The cap 144 is connected to the guide 126 to support the right side of the frame assembly 102. The lower ends of the forward and rear supports 146, 148 are connected to a cross member 149 that extends parallel to the ground and transverse to the vertical plane defined by the movable frame 102. Wheels or casters 192 may be connected to each end of the cross member 149 to allow the press 100 to be easily moved from one location to another. The left support frame 128 is similar to the right support frame 130 discussed above. In some embodiments, including the illustrated embodiment, a platform 194 extends between the cross members of the support frames 128, 130 to provide additional structural support for the press 100.

Two hydraulic rams 140, 142 are connected to the lower frame assembly 114 and the press assembly 116. The hydraulic rams 140, 142 are offset from a vertical centerline of the movable frame 102. By offsetting the hydraulic rams 140, 142, the forces acting on the movable frame 102 and the press assembly 116 are more balanced, resulting in evenly applied pressure to a workpiece and less stress on the components of the press. In some embodiments, the hydraulic rams 140, 142 are separated by at least 20 inches, at least 22 inches, or at least 25 inches. In some embodiments, the hydraulic rams 140, 142 are mounted approximately 10 inches, approximately 12 inches, or approximately 14 inches from the exterior sides of the frame 102. In some embodiments, including the illustrated embodiment, the hydraulic rams 140, 142 may be tie-rod hydraulic cylinders having a 10 inch stroke, a 3.5 inch bore, and a working PSI of 3000 psi, such as the Prince Tie-Rod Cylinders available from Northern Tool and Equipment.

Figure 3A:
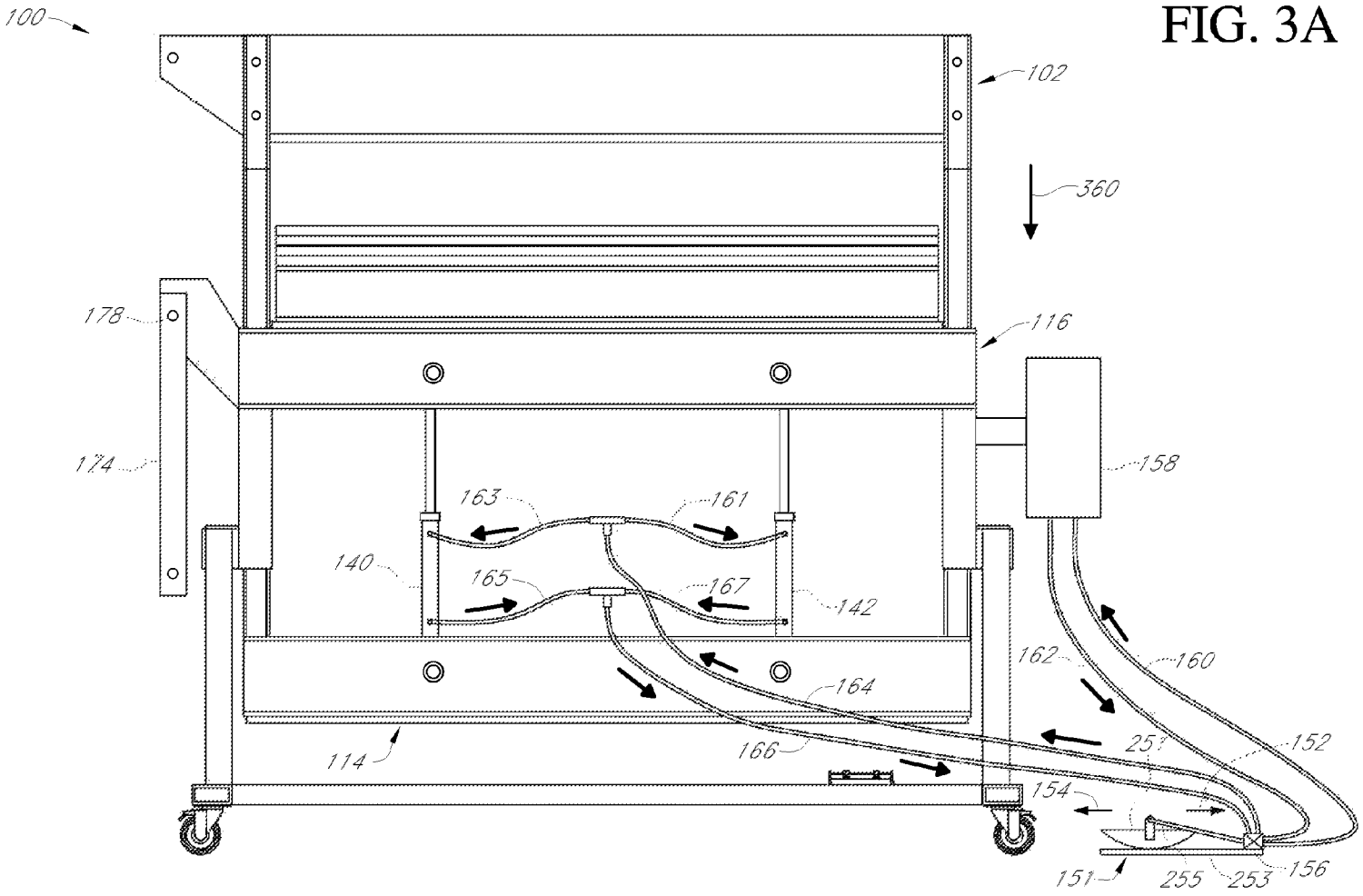
FIG. 3A is a front view of the sheet metal brake press of FIG. 2 also illustrating a power system used to control operation of the brake press.
Figure 3B:
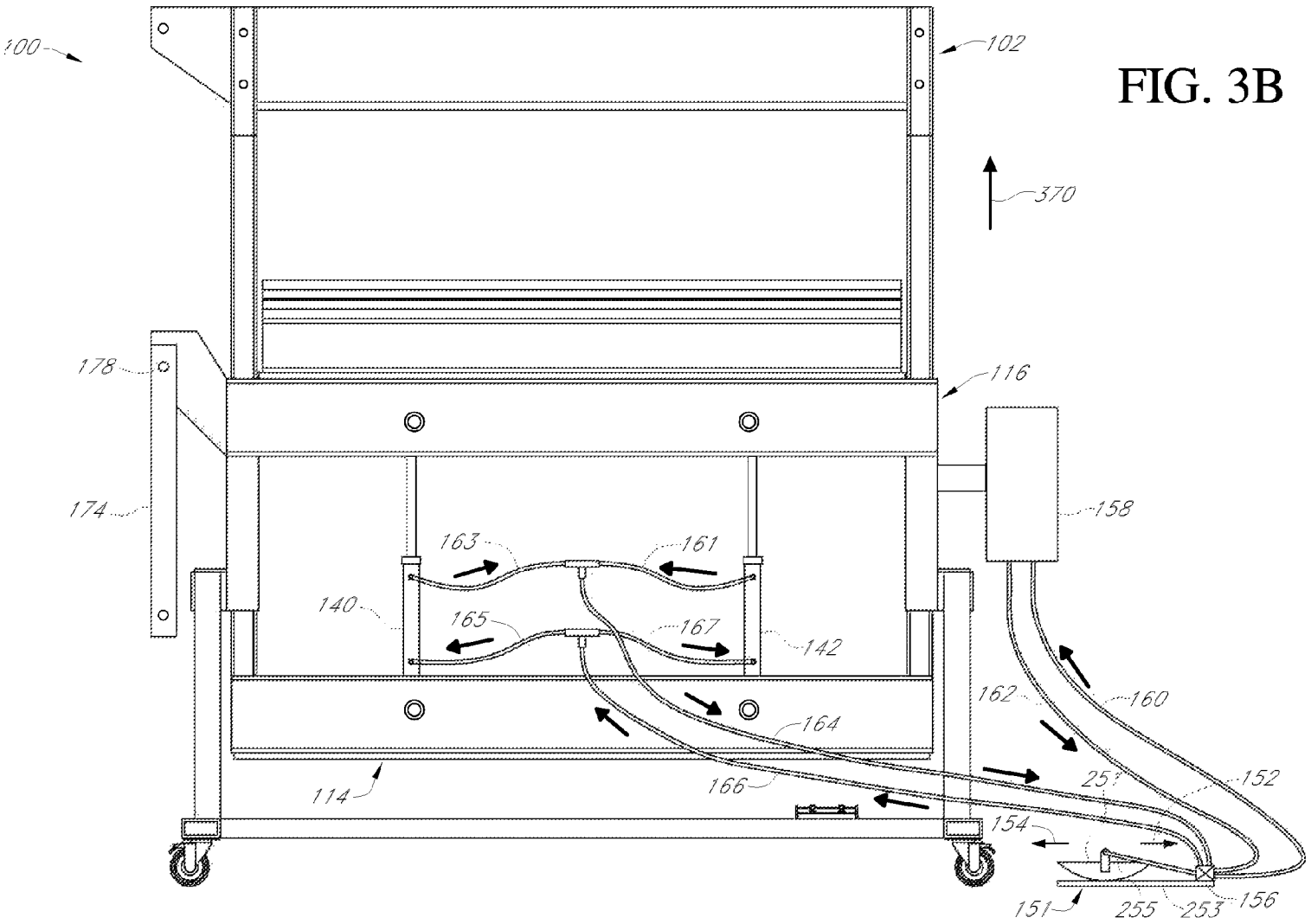
FIG. 3B is another front view of the sheet metal brake press of FIG. 2 also illustrating a power system used to control operation of the brake press.

FIGS. 3A and 3B illustrate the hydraulic assembly and user input control assembly for a sheet metal brake press such as the press 100. FIG. 3A illustrates the hydraulic assembly and flow of hydraulic fluid when the movable frame 102 is lowered to perform a bending operation. FIG. 3B illustrates the hydraulic assembly and flow of hydraulic fluid when the movable frame 102 is raised after performing a bending operation. The hydraulic assembly includes a hydraulic power unit or pump 158 that may be vertically mounted to the non-movable press assembly 116. In one example, a hydraulic power unit such as the Haldex 1HP 115/208-230 Volt AC Hydraulic Power Unit Model #1530036 provided by Northern Tool and Equipment may be used. The user input control assembly includes a foot pedal assembly 151 that includes a base member 253, a rocking foot pedal 251, a valve 156 and a linkage 255 connected to the foot pedal 251 and the valve 156. The hydraulic power unit 158 is connected via two hydraulic lines 160, 162 to the valve 156 of the foot pedal assembly 151. The valve 156 is also connected to the two chambers of the hydraulic rams 140, 142 via lines 161, 163, 164, 165, 166, 167 that control the expansion and contraction of the hydraulic rams. In some embodiments, including the illustrated embodiment, the valve 156 may be a control valve having a 0.5 inch port size, max flow of 15 GPM and a maximum psi of 3000 psi, such as the HydraStar Flow Control Valve available from Northern Tool and Equipment.

As illustrated in FIG. 3A, to expand the hydraulic rams 140, 142 to lower the frame 102, hydraulic fluid flows from the hydraulic pump 158 via pressure line 162, through the valve 156 and through line 164 and lines 165, 167 to the expansion chambers of the hydraulic rams 140, 142. The increase of fluid in these chambers forces the pistons of each hydraulic ram 140, 142 to extend, lengthening the hydraulic rams 140, 142 and applying force on the lower frame assembly 114 to lower the frame 102 as indicated by arrow 360. Fluid in the other chambers of the hydraulic rams 140, 142 on the other side of the pistons is forced out of the hydraulic rams and passes through lines 161, 163, and 166, via valve 156, to the pump 158 via return line 160.

As illustrated in FIG. 3B, to contract the hydraulic rams 140, 142 to raise the frame 102, hydraulic fluid flows from the hydraulic pump 158 via line 162, through the valve 156 and through line 166 and lines 161, 163 to the contraction chambers of the hydraulic rams 140, 142. The increase of fluid in these chambers forces the hydraulic rams 140, 142 to shorten, applying force on the lower frame assembly 114 to raise the frame 102 as indicated by arrow 370. Fluid in the other chambers of the hydraulic rams 140, 142 is forced out of the hydraulic rams due to the motion of the pistons and passes through lines 165, 167, and 164, via valve 156, to the pump 158 via return line 160.

Flow of fluid into either the expansion or contraction chambers of the hydraulic rams 140, 142 occurs through control of the valve 156 by pressure of the user's foot on the pedal 251 acting through the linkage 255. As the user rocks the pedal 251 forward in direction 152, the hydraulic fluid flows as discussed above with respect to FIG. 3B to cause the hydraulic rams 140, 142 to contract and raise the movable frame 102 as indicated by arrow 370 by pulling on the lower frame assembly 114, resulting in the punch edge 110 moving upward and away from a die 121. As the user rocks the pedal 251 backward in direction 154, the hydraulic fluid flows as discussed above with respect to FIG. 3A to cause the hydraulic rams 140, 142 to expand and lower the movable frame 102 as indicated by arrow 360 by pushing on the lower frame assembly 114. This results in movement of the punch edge 110 towards the die 121. In some embodiments, including the illustrated embodiment, the rate of movement of the hydraulic rams 140, 142 may be controlled by how far the pedal 251 is rotated in either the forward direction 152 or backward direction 154. Contrary to prior art systems, release of the foot pedal 251 causes the hydraulic rams 140, 142 to stop operation and hold position, thereby maintaining the movable frame 102 in the position set by the user. This arrangement allows the user to discretely and accurately control the upward and downward movement of the movable frame 102 and the punch edge 110 such that bending operations can be accurately completed with reduced waste of work material.

Figure 5B:
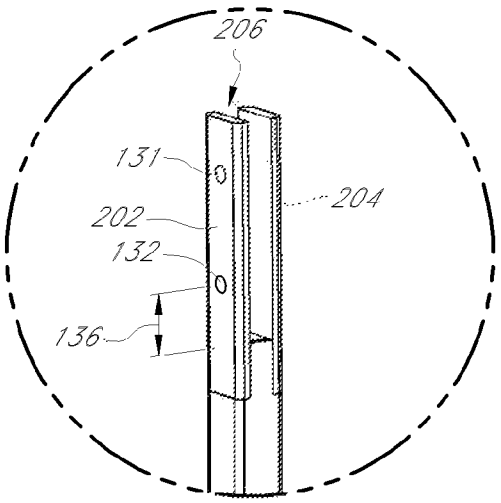
FIG. 5B is a detailed view of an upper end of one of the side support members illustrated in FIG. 5A.
Figure 5A:
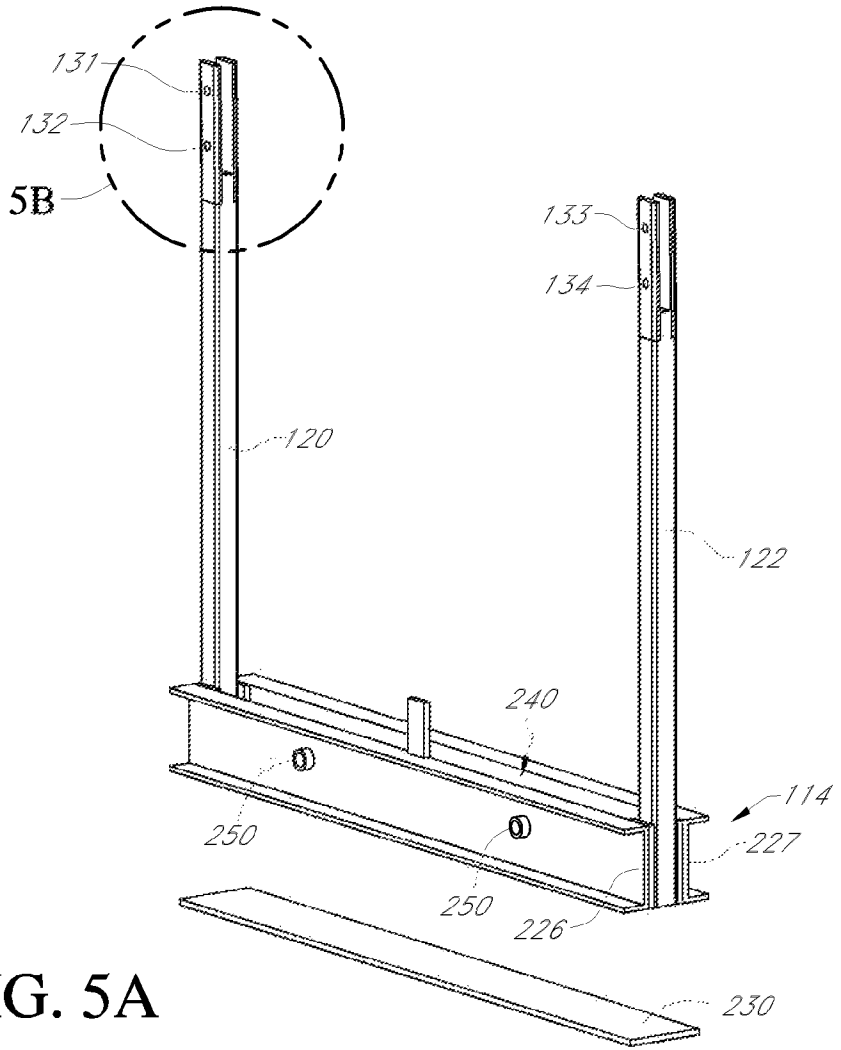
FIG. 5A is a view of side support members and a bottom frame assembly of a brake press according to one embodiment.

With continued reference to FIG. 2, the upper frame assembly 112 includes a cross member 212 which, in some embodiments, may be a flat bar having a length of approximately 55 inches, a vertical height of approximately 8 inches and a width of approximately 1 inch. The cross member 212 may be bolted to the side frame supports 120, 122 with bolts 131, 132, 133, 134 that extend through securing plates welded or otherwise connected to the upper ends of the side frame supports 120, 122. As shown in greater detail in FIGS. 5A and 5B, securing plates 202, 204 extend from the upper end of side frame support 120 to form a U-shaped channel 206. The channel 206 is configured to receive one end of the cross member 212. Each of the securing plates 202, 204 include bolt holes to allow bolts to pass through the securing plates 202, 204 and the cross member 212 to secure the cross member 212 as part of the frame assembly 102. Similar securing plates may be used at the upper end of the side frame support 122 to secure the opposite end of the cross member 212, as shown in FIG. 2. The U-shaped channel 206 has a clearance 136 of approximately 0.5 inch to allow the cross member 212 to pivot. In some embodiments, the clearance 136 may be between approximately 0.25 inch and 1 inch, between approximately 0.30 inch and 0.75 inch, or between 0.40 inch and 0.60 inch. In other embodiments, the clearance 136 may be at least 0.25 inch, at least 0.40 inch, at least 0.50 inch, at least 0.60 inch, at least 0.75 inch, or at least 1 inch.

Referring again to FIG. 2, the upper frame assembly 112 can include a punch edge or edge 110 configured to mate with a coordinating die 121 connected to or placed on the top of the press assembly 116. A workpiece, such as a piece of sheet metal, is placed on the die 121. As the hydraulic rams 140, 142 are activated, such as by pressing the foot pedal 251 shown in FIGS. 3A and 3B and discussed above, the lower frame assembly 114 is pushed away from the press assembly 116. As the lower frame assembly 114 travels downward, the side frame supports 120, 122 travel with respect to the side guides 124, 126 and the upper frame assembly 112 and the punch edge 110 descend toward the press assembly 116 and the die 121. The hydraulic rams 140, 142 move the movable frame 112 downward toward the ground until the punch edge 110 of the upper frame assembly 112 applies pressure to the workpiece to bend the metal between the punch edge and the die 121. By pressing the foot pedal 251 in the opposite direction, as discussed above with respect to FIGS. 3A and 3B, the lower frame assembly 114 is pulled towards the press assembly 116, raising the punch edge 110 away from the die 121.

Figure 4A:
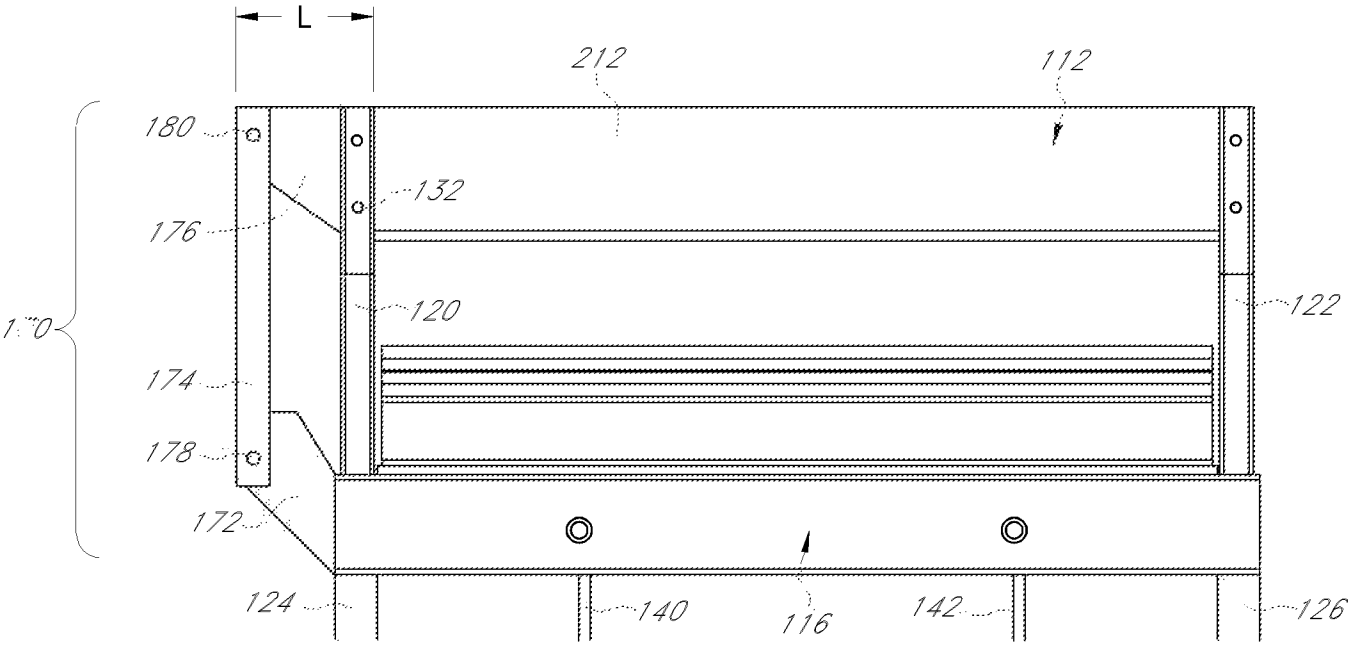
FIG. 4A is a front perspective view of a top frame assembly and press assembly of a brake press having a pivotable top member.
Figure 4B:
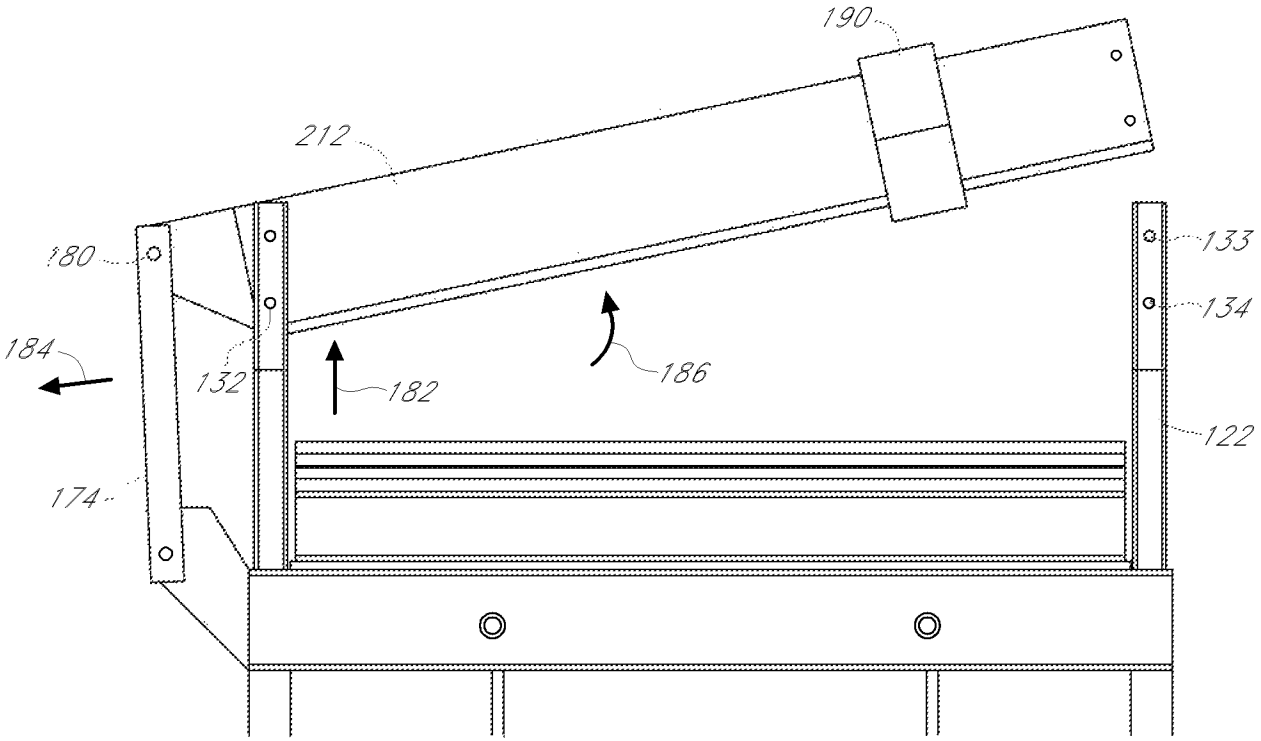
FIG. 4B is a view of the brake press of FIG. 4A with the top member pivoted away from the side support member.

In some embodiments, including the embodiment illustrated in FIGS. 4A and 4B, the cross member 212 of the upper frame assembly 112 can pivot or rotate about one of the bolt connections 131, 132, 133, 134. In some embodiments, including the illustrated embodiment, a pivoting assembly 170 includes a lower pivot support 172 welded or otherwise secured on one end to the press assembly 116. A lower pivot attachment 178 is at the other end of the pivot support 172. The pivoting assembly 170 also includes an upper pivot support 176 The upper pivot support 176 is welded or otherwise connected to the cross member 212 at one end. The upper pivot support 176 also includes an upper pivot attachment 180 at the other end of the pivot support 176. In some embodiments, the upper pivot support 176 is formed integrally with the cross member 212. A linkage 174 is detachably connected to the lower pivot attachment 178 at one end and to the upper pivot attachment 180 at the other end. In some embodiments, including the illustrated embodiment, a length L of the upper pivot support 176 is approximately 6 inches. In some embodiments, the length L of the upper pivot support member is between approximately 3 inches and 1 foot, between approximately 4 inches and 9 inches, or between approximately 5 inches and 7 inches. The length L has been determined to fall within the ranges listed above to provide various mechanical advantages, including desirable angular rotation of the cross member 212 for a limited amount of vertical travel of the frame 102 while limiting the force required to rotate the cross member 212. Additionally, the length L has been determined to fall within the ranges listed above to limit the stress on the linkage 174. In some embodiments, including the illustrated embodiment, a length of the linkage 174 is between approximately 1 foot and approximately 3.5 feet, between approximately 1.5 feet and approximately 2.5 feet, or between approximately 1.75 feet and approximately 2.5 feet.

To pivot the cross member 212 as shown in FIG. 4B, the bolts passing through connection points 133 and 134 are removed so that the cross member 212 is not connected to the side frame support 122, that is, the side frame support opposite the pivoting assembly 170. Additionally, one of the bolts is removed from either of the connection points 131 or 132. In FIGS. 4A and 4B, the bolt has been removed from the upper connection point 131. The linkage 174 is connected to the upper pivot attachment 180. As the hydraulics are activated to move the frame assembly 102 vertically upward as shown by arrow 182, the linkage 174 rotates outward as shown by arrow 184 and acts on the upper pivot attachment point 180, applying a force that causes the cross member 212 to pivot upward about the bolt through the connection point 132, as shown by arrow 186. In some embodiments, the angle of rotation of the cross member 212 as indicated by arrow 186 is at least 30 degrees, at least 45 degrees, at least 60 degrees, at least 90 degrees, or at least 135 degrees. Desirably, the no portion of the cross member 212 to the left of the connection point used as the pivot point for the cross member 212 contacts the side frame support. The cross member 212 may be pivoted back into place for connection with the side frame support 122 by reversing the direction of the hydraulics to move the frame assembly 102 in the down or opposite direction. While FIGS. 4A and 4B illustrate rotation of the cross member 212 about one of the connection points on the side frame support 120, the cross member 212 may be similarly configured to rotate about one of the connection points 133, 134 on the right side support 122.

Pivoting the cross member 212 allows a fully formed or "boxed" workpiece, such as the piece 190 shown in FIG. 4B, to be easily removed from the press. As the cross member 212 is heavy, long, and unwieldy, removing the cross member 212 by hand and lifting it from the frame assembly 102 can be difficult and dangerous for the user. Attaching the linkage 174 and removing the bolts connecting the end of the cross member 212 opposite the pivoting assembly 170 to the side frame member allows the cross member 212 to be easily pivoted or rotated in the vertical plane away from the side frame support to easily slide a box workpiece off the cross member 212.

As illustrated in FIGS. 3A and 3B, the linkage 174 may be disconnected from the upper pivot attachment 180 so that the linkage 174 hangs from the lower pivot attachment 178. This allows for full range of motion of the movable frame 102 to allow the punch edge 110 to contact the workpiece placed on the die 121 as discussed above.

Figure 6:
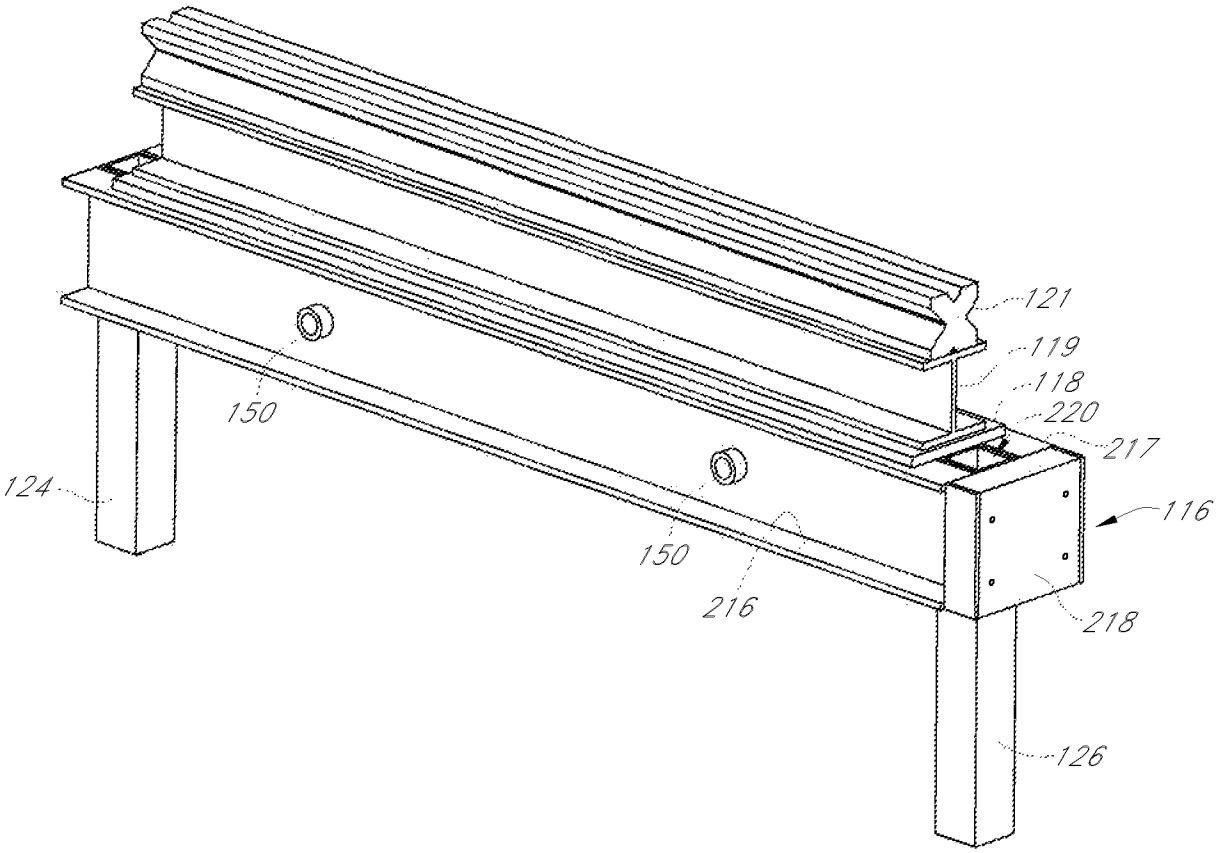
FIG. 6 is a view of one embodiment of a press assembly for a brake press.

As shown in FIG. 6, the press assembly 116 includes a press front channel 216 and a press rear channel 217. In some embodiments, including the illustrated embodiment, the front and rear channels 216, 217 may be 6 inch heavy channel members. The front and rear channels 216, 217 may be connected by an end cap 218 that is bolted or welded to the ends of each of the front and rear channels 216, 217 such that an elongated channel or opening 220 is formed between the front and rear channels 216, 217. In some embodiments, a flat plate 118 may be placed or secured to an upward facing surface of the front channels 216, 217 to provide a flat surface on which to place or secure a die. As illustrated in FIG. 6, an I-beam 119 may be placed on or secured to the flat plate 118. The die 121 may be placed on an upward facing surface of the I-beam 119. The embodiment illustrated in FIG. 6 provides greater flexibility to perform desired bending or forming operations using the press 100. Bosses 150 may be provided on one of the forward or rearward facing surfaces of the front and rear channels 216, 217. The hydraulic rams 140, 142 are connected to the bosses 150.

As further illustrated in FIG. 6, the die 121 may have a different profile on each of the four elongated sides of the die. The die 121 may be rotated about an axis defined by the longitudinal length of the die such that the desired profile is facing upward when the workpiece is pressed between the desired face of the die 121 and the punch edge 110 of the upper frame assembly 112.

Figure 7:
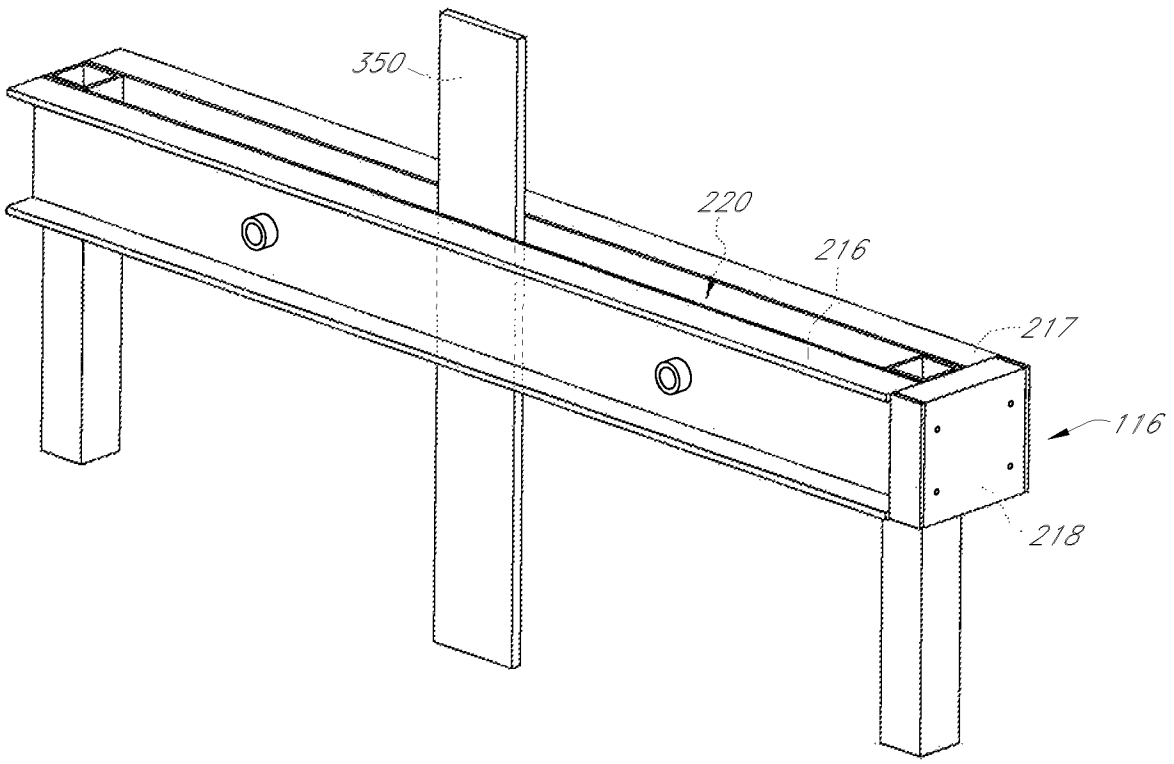
FIG. 7 is a view of another embodiment of a press assembly for a brake press.

In other configurations, as shown in FIG. 7, the flat plate 118, I-beam 119, and die 121 may be removed, exposing the opening 220. A workpiece 350 may be inserted within the opening 220 and clamped, held, or otherwise supported such that the workpiece 350 may be formed while in a vertical orientation. By allowing a workpiece to be oriented vertically within the press 100, rather than inserted orthogonal to the vertical plane defined by the frame 102, lengthy workpieces such as axles, etc. may be used with the press 100.

With reference again to FIG. 5A, the lower frame assembly 114 includes, in one embodiment, a lower front channel 226 and a lower rear channel 227. In some embodiments, including the illustrated embodiment, the front and rear channels 226, 227 may be 6 inch heavy channel members. The front and rear channels 226, 227 may be connected (such as, for example, bolted or welded) to the front and rear surfaces of the side frame supports 120, 122 such that an elongated channel or opening 240 is formed between the front and rear channels 226, 227. In some embodiments, a flat plate 230 may be secured by any means such as mechanical fasteners or welding to the undersides of the front and rear channels 226, 227 such that the flat plate 230 is oriented parallel to the ground. The flat plate 230 provides greater structural integrity to the lower frame assembly 114 and prevents the lower frame assembly 114 from bowing or warping while the press is operated. Bosses 250 may be provided on one of the forward or rearward facing surfaces of the front and rear channels 226, 227. The hydraulic rams 140, 142 are connected to the bosses 250. Application of force from the hydraulic rams 140, 142 on the bosses 250 results in either upward or downward movement of the movable frame 102 as discussed above.

In some embodiments, including the illustrated embodiment, an exterior width of the frame 102 measured in parallel to the ground in the vertical plane defined by the frame 102 is between approximately 40 inches and 65 inches, between approximately 45 inches and 60 inches, or between approximately 50 inches and 55 inches. In other embodiments, the exterior width of the frame 102 is at least 40 inches, at least 45 inches, or at least 50 inches. In some embodiments, including the illustrated embodiment, a height of the frame 102 measured in the vertical plane is between approximately 30 inches and 65 inches, between approximately 40 inches and 60 inches, or between approximately 45 inches and 55 inches. In other embodiments, the height of the frame 102 is at least 35 inches, at least 40 inches, or at least 45 inches.

In some embodiments, including the illustrated embodiment, a length of the die 121 is between approximately 30 inches and 65 inches, between approximately 40 inches and 60 inches, or between approximately 45 inches and 55 inches. In other embodiments, the length of the die 121 is at least 35 inches, at least 40 inches, or at least 45 inches.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term 'including' should be read to mean 'including, without limitation,' 'including but not limited to,' or the like; the term 'comprising' as used herein is synonymous with 'including,' 'containing,' or 'characterized by,' and is inclusive or open-ended and does not exclude additional, unrecited elements or method steps; the term 'having' should be interpreted as 'having at least;' the term 'includes' should be interpreted as 'includes but is not limited to;' the term 'example' is used to provide exemplary instances of the item in discussion, not an exhaustive or limiting list thereof; adjectives such as 'known', 'normal', 'standard', and terms of similar meaning should not be construed as limiting the item described to a given time period or to an item available as of a given time, but instead should be read to encompass known, normal, or standard technologies that may be available or known now or at any time in the future; and use of terms like 'preferably,' 'preferred,' 'desired,' or 'desirable,' and words of similar meaning should not be understood as implying that certain features are critical, essential, or even important to the structure or function of the invention, but instead as merely intended to highlight alternative or additional features that may or may not be utilized in a particular embodiment of the invention. Likewise, a group of items linked with the conjunction 'and' should not be read as requiring that each and every one of those items be present in the grouping, but rather should be read as 'and/or' unless expressly stated otherwise. Similarly, a group of items linked with the conjunction 'or' should not be read as requiring mutual exclusivity among that group, but rather should be read as 'and/or' unless expressly stated otherwise.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

Furthermore, although the foregoing has been described in some detail by way of illustrations and examples for purposes of clarity and understanding, it is apparent to those skilled in the art that certain changes and modifications may be practiced. Therefore, the description and examples should not be construed as limiting the scope of the invention to the specific embodiments and examples described herein, but rather to also cover all modification and alternatives coming with the true scope and spirit of the invention.

Although this application discloses certain preferred embodiments and examples, it will be understood by those skilled in the art that the present inventions extend beyond the specifically disclosed embodiments to other alternative embodiments and/or uses of the invention and obvious modifications and equivalents thereof. Further, the various features of these inventions can be used alone, or in combination with other features of these inventions other than as expressly described above While the disclosed embodiments are primarily directed to a protection system for a handheld electronic device, aspects of the invention may be used in connection with other types of protection systems. Thus, it is intended that the scope of the present inventions herein disclosed should not be limited by the particular disclosed embodiments described above, but should be determined only by a fair reading of the claims that follow.

What is claimed is:

1. A brake press, comprising:

a movable frame comprising a first side support and a second side support, an upper frame assembly and a lower frame assembly, the upper frame assembly comprising an upper cross member connected to first ends of the first and second side supports, and the lower frame assembly comprising a lower cross member connected to second ends of the first and second side supports, the second ends opposite the first ends of the first and second side supports, the frame defining a vertical plane, the frame comprising a punch edge movable with said upper cross member, the punch edge extending towards the lower cross member and the upper cross member pivotable with respect to at least one of the first and second side supports;

a stationary press assembly comprising a first press support, a second press support, and a die supported directly or indirectly by the first and second press supports and facing the punch edge, the first and second press supports connected to each other to define an elongated opening between them, a first end of the press assembly connected to a first guide and a second end of the press assembly opposite the first end connected to a second guide, the first guide configured such that the first side support travels vertically with respect to the first guide as the frame travels in the vertical plane, the second guide configured such that the second side support travels vertically with respect to the second guide as the frame travels in the vertical plane; and a power assembly comprising at least two hydraulic rams, a hydraulic power unit, and an input control assembly connected to the at least two hydraulic rams and the hydraulic power unit, the at least two hydraulic rams supported by the lower cross member and connected to the press assembly such that activation of the power assembly by the input control assembly controls the motion of the frame assembly in the vertical plane such that the punch edge moves towards and away from the press assembly.

2. The brake press of claim 1, wherein the frame first side support comprises a first pivot and a second pivot, a front surface, back surface, and left and right surfaces such that the front and back surfaces form a first channel on a first end of the first side support configured to receive a first end of the upper cross member and the second side support comprises a front surface, back surface, and left and right surfaces such that the front and back surfaces form a second channel on a first end of the second side support configured to receive a second end of the upper cross member and the first and second channels are configured such that either of the first end or the second end of the upper cross member can rotate in the vertical plane with respect to one of the first and second side supports.

3. The brake press of claim 2, wherein the lower cross member comprises a first channel and a second channel, the first channel connected to the first and second side supports and the second channel connected to the first and second side supports to define an opening between the first and second channels.

4. The brake press of claim 3, wherein the lower cross member further comprises a bottom plate connected to an underside of the first and second channels.

5. The brake press of claim 1, wherein the input control assembly comprises a control component connected to the two hydraulic rams and the hydraulic reservoir via a four-way valve such that pressing the control component in a first direction controls the speed of frame moving the punch edge towards the die, pressing the control component in a second direction controls the speed of the frame moving the punch edge away from the die, and releasing the control component stops movement of the frame.

6. The brake press of claim 5, wherein the control component is foot-operated.

7. The brake press of claim 1 further comprising a pivoting assembly comprising a lower pivot support secured to a first end of the press assembly, an upper pivot support connected to a first end of the upper frame assembly, and a linkage connecting the lower pivot support to the upper pivot support such that movement of the frame in a vertical direction within the vertical plane rotates a second end opposite the first end of the upper cross member of the upper frame assembly away from one of the first and second side supports.

8. The brake press of claim 7, wherein the first ends of the first and second side supports have U-shaped supports with two bolts on each side to connect the upper cross member to each of the first and second side supports, the U-shaped supports having a clearance between a lower interior surface of the U-shaped supports and the upper cross member to allow pivoting of the upper cross member.

9. The brake press of claim 1, wherein the die is a 4-sided rotatable die.

10. The brake press of claim 1, wherein the punch edge is non-integral with the upper cross member.

11. The brake press of claim 10, wherein the punch edge is directly or indirectly secured to the upper cross member.

12. The brake press of claim 1, wherein the die is non-integral with the first and second press supports.

13. The brake press of claim 12, wherein the die is directly or indirectly secured to the first and second press supports.

14. A brake press, comprising:

a movable frame comprising a first side support and a second side support, an upper frame assembly and a lower frame assembly, the upper frame assembly comprising an upper cross member connected to first ends of the first and second side supports, and the lower frame assembly comprising a lower cross member connected to second ends of the first and second side supports, the second ends opposite the first ends of the first and second side supports, the frame defining a vertical plane, the frame comprising a punch edge movable with said upper cross member, the punch edge extending towards the lower cross member and the upper cross member pivotable with respect to at least one of the first and second side supports;

a stationary press assembly comprising a first press support, a second press support, and a die supported directly or indirectly by the first and second press supports and facing the punch edge, the first and second press supports connected to each other to define an elongated opening between them, a first end of the press assembly connected to a first guide and a second end of the press assembly opposite the first end connected to a second guide, the first guide configured such that the first side support travels vertically with respect to the first guide as the frame travels in the vertical plane, the second guide configured such that the second side support travels vertically with respect to the second guide as the frame travels in the vertical plane; and a power assembly comprising at least two hydraulic rams, a hydraulic power unit, and an input control assembly connected to the at least two hydraulic rams and the hydraulic power unit, the at least two hydraulic rams supported by the lower cross member and connected to the press assembly such that activation of the power assembly by the input control assembly controls the motion of the frame assembly in the vertical plane such that the punch edge moves towards and away from the press assembly;

wherein the input control assembly comprises a control component connected to the two hydraulic rams and the hydraulic reservoir via a four-way valve such that pressing the control component in a first direction controls the speed of frame moving the punch edge towards the die, pressing the control component in a second direction controls the speed of the frame moving the punch edge away from the die, and releasing the control component stops movement of the frame.

15. The brake press of claim 14, wherein the frame first side support comprises a first pivot and a second pivot, a front surface, back surface, and left and right surfaces such that the front and back surfaces form a first channel on a first end of the first side support configured to receive a first end of the upper cross member and the second side support comprises a front surface, back surface, and left and right surfaces such that the front and back surfaces form a second channel on a first end of the second side support configured to receive a second end of the upper cross member and the first and second channels are configured such that either of the first end or the second end of the upper cross member can rotate in the vertical plane with respect to one of the first and second side supports.

16. The brake press of claim 14, wherein the control component is foot-operated.

17. The brake press of claim 14 further comprising a pivoting assembly comprising a lower pivot support secured to a first end of the press assembly, an upper pivot support connected to a first end of the upper frame assembly, and a linkage connecting the lower pivot support to the upper pivot support such that movement of the frame in a vertical direction within the vertical plane rotates a second end opposite the first end of the upper cross member of the upper frame assembly away from one of the first and second side supports.

18. The brake press of claim 17, wherein the first ends of the first and second side supports have U-shaped supports with two bolts on each side to connect the upper cross member to each of the first and second side supports, the U-shaped supports having a clearance between a lower interior surface of the U-shaped supports and the upper cross member to allow pivoting of the upper cross member.

19. A method of using a brake press comprising:

assembling a brake press comprising the steps of:

providing a movable frame comprising a first side support and a second side support, an upper frame assembly and a lower frame assembly, the upper frame assembly comprising a upper cross member connected to first ends of the first and second side supports, and the lower frame assembly comprising a lower cross member connected to second ends of the first and second side supports, the second ends opposite the first ends of the first and second side supports, the frame defining a vertical plane, the frame comprising a punch edge movable with said upper cross member, the punch edge extending towards the lower cross member and the upper cross member pivotable with respect to at least one of the first and second side support members;

providing a stationary press assembly comprising a first press support, a second press support, and a die supported directly or indirectly by the first and second press supports and facing the punch edge, the first and second press supports connected to each other to define an elongated opening between them, a first end of the press assembly connected to a first guide and a second end of the press assembly opposite the first end connected to a second guide, the first guide configured such that the first side support travels vertically with respect to the first guide as the frame travels in the vertical plane, the second guide configured such that the second side support travels vertically with respect to the second guide as the frame travels in the vertical plane; and providing a power assembly comprising at least two hydraulic rams, a hydraulic power unit, and an input control assembly connected to the hydraulic rams and the hydraulic power unit, the at least two hydraulic rams supported by the lower cross member and connected to the press assembly such that activation of the power assembly by the input control assembly controls the motion of the frame assembly in the vertical plane such that the punch edge moves towards and away from the press assembly;

inserting a piece to be pressed between the punch edge and the die; and operating the brake press, comprising the steps of:

manipulating the input control assembly to lower the frame assembly relative to the press assembly to press the piece between the die and the punch edge.

* * * * *